US005645235A

United States Patent [19]

Witte

[11] Patent Number: 5,645,235

[45] Date of Patent: Jul. 8, 1997

[54] DUMP TRUCK WITH MOUNTED COMMINUTING DEVICE

[76] Inventor: Joseph H. Witte, 414 Dudley St., Narberth, Pa. 19072

[21] Appl. No.: 533,311

[22] Filed: Sep. 25, 1995

[51] Int. Cl.[6] ..... B02C 19/00

[52] U.S. Cl. ..... 241/101.741; 241/285.2

[58] Field of Search ..... 241/285.2, 285.1, 241/100, 101.74, 101.741, 101.742, 101.72, 101.78; 29/700

[56] References Cited

U.S. PATENT DOCUMENTS

| | | | |
|---|---|---|---|
| 954,540 | 4/1910 | Prilliman . | |
| 3,682,402 | 8/1972 | Goldhammer | 241/100 |
| 4,143,823 | 3/1979 | Judson | 241/100 X |
| 4,786,003 | 11/1988 | Johnson . | |
| 4,961,539 | 10/1990 | Deem . | |
| 5,102,056 | 4/1992 | Ober | 241/100 X |
| 5,186,397 | 2/1993 | Orlando . | |
| 5,215,264 | 6/1993 | Lundquist . | |
| 5,240,188 | 8/1993 | Whitmire . | |
| 5,379,951 | 1/1995 | Hughs . | |
| 5,395,061 | 3/1995 | Merklinger | 241/101.71 |

FOREIGN PATENT DOCUMENTS

| | | | |
|---|---|---|---|
| 2479708 | 10/1981 | France | 241/100 |
| 3412155 | 10/1985 | Germany | 241/285.3 |

*Primary Examiner*—Mark Rosenbaum
*Attorney, Agent, or Firm*—LaMorte & Associates

[57] ABSTRACT

A comminution system that is used in conjunction with a dump tuck vehicle so that comminuted debris is automatically deposited into the dump bed of the vehicle. The comminution device is a self-powered assembly that rides upon rails mounted to the dump truck vehicle. The rails are mounted to either side of the vehicle's dump bed and support the comminution device directly over the dump bed. The comminution device is free to move along the length of the rails. As a result, the comminution device can be selectively positioned over different areas of the dump bed, thereby filling different areas of the dump bed in a controlled and even manner. Rails are also mounted to the dump truck vehicle over the passenger cab, wherein the passenger cab rails align with the dump bed rails when the dump bed is flat. As a result, the comminution device can be selectively moved off the dump bed rails and onto the passenger cab rails. Once the comminution device has been moved onto the passenger cab rails, the dump bed is free to dump its load of comminuted debris.

16 Claims, 3 Drawing Sheets

DUMP TRUCK WITH MOUNTED COMMINUTING DEVICE

BACKGROUND OF THE INVENTION

1. Field of the Invention

The present invention relates in general to comminution machines such as chippers and shredders that are commonly used for the comminution of leaves, branches and other such material. More particularly, the present invention relates to comminution devices mounted upon a truck, wherein the comminuted materials are automatically deposited within the bed of the truck.

2. Description of the Prior Art

The prior art is replete with various comminution machines specifically designed to chip or shred plant material such as leaves, branches, grass cuttings and the like. Many of the larger comminution machines are built upon a trailer, thereby allowing the comminution machine to be towed by a truck. Traditional commercial comminution machines, such as those used by tree service companies and landscapers, contain cutting blades positioned at ground level or at the low level of the trailer. As branches and leaves are passed through the cutting blades, the comminuted debris is expelled through an exit shoot. Trailer supported commercial comminution machines are commonly towed behind a dump truck, wherein the exit shoot of the comminution machine is directed into the bed of the truck. Using this configuration, material can be fed through the comminution machine until the dump truck is full. At this point, the comminution machine must be detached from the dump truck so that the dump truck is free to dump its load of comminuted debris.

The problem associated with this typical prior art scenario is that trailer based commercial comminution machines are large, bulky and heavy. This makes the comminution machine very difficult to manually maneuver. Consequently, it takes a great deal of time and labor to remove and reattach the comminution machine trailer from and to the dump truck. Furthermore, the load bed of the dump truck fills quickly with the loosely packed comminuted debris. As a result, the comminution machine trailer must often be removed from the dump truck as it becomes full, dumps its load and returns. The labor and time wasted removing and reattaching the comminution machine trailer is significant, greatly reducing the productivity of the employees of the tree service or landscaper.

In the prior art, attempts have been made to eliminate the need to remove and reattach a comminution machine from a tow vehicle by designing the comminution machine directly into the structure of a vehicle. Such prior art is exemplified by U.S. Pat. No. 4,786,003 to Johnson, entitled MATERIALS PROCESSING UNIT; U.S. Pat. No. 4,961,539 to Deem, entitled TRUCK-MOUNTED PALLET CHIPPER and U.S. Pat. No. 5,215,264 to Lundquist, entitled CONVEYING AND PROCESSING APPARATUS FOR VEHICLE MOUNTED SIZE REDUCTION EQUIPMENT. These prior art references position comminution machinery between the passenger cab of the vehicle and the dump bed at the rear of the vehicle. As a result, the vehicles are free to dump their loads without effecting the comminution machinery. The prior art exemplified by the three above referenced patents, all show large dedicated vehicles that have to be custom built. As a result, such custom vehicles are extremely expensive and would only be in the budget of a large municipality and not a small tree service or landscaping organization.

It is therefore an object of the present invention to provide a comminution device that can be added to an existing dump truck vehicle in a low cost manner, wherein the comminution device deposits comminuted debris directly into the bed of the dump truck in a manner that does not effect the ability of the dump truck to dump its load.

It is a further object of the present invention to provide a comminution device that is supported by a dump truck and can be selectively repositioned to various points on the dump truck, thereby enabling comminuted debris to be loaded into the dump truck in an even and controlled manner.

SUMMARY OF THE INVENTION

The present invention is a comminution system that is used in conjunction with a dump tuck vehicle so that comminuted debris is automatically deposited into the dump bed of the vehicle. The comminution device is a self powered assembly that rides upon rails mounted to the dump truck vehicle. The rails are mounted to either side of the vehicle's dump bed and support the comminution device directly over the dump bed. The comminution device is free to move along the length of the rails. As a result, the comminution device can be selectively positioned over different areas of the dump bed, thereby filling different areas of the dump bed in a controlled and even manner.

Rails are also mounted to the dump truck vehicle over the passenger cab, wherein the passenger cab rails align with the dump bed rails when the dump bed is flat. As a result, the comminution device can be selectively moved from the dump bed rails and onto the passenger cab rails. Once the comminution device has been moved onto the passenger cab rails, the dump bed is free to dump its load of comminuted debris. After a load is dumped and the dump bed returns to its flat orientation, the comminution device can be rolled back onto the dump bed rails, and the system is again ready for use.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
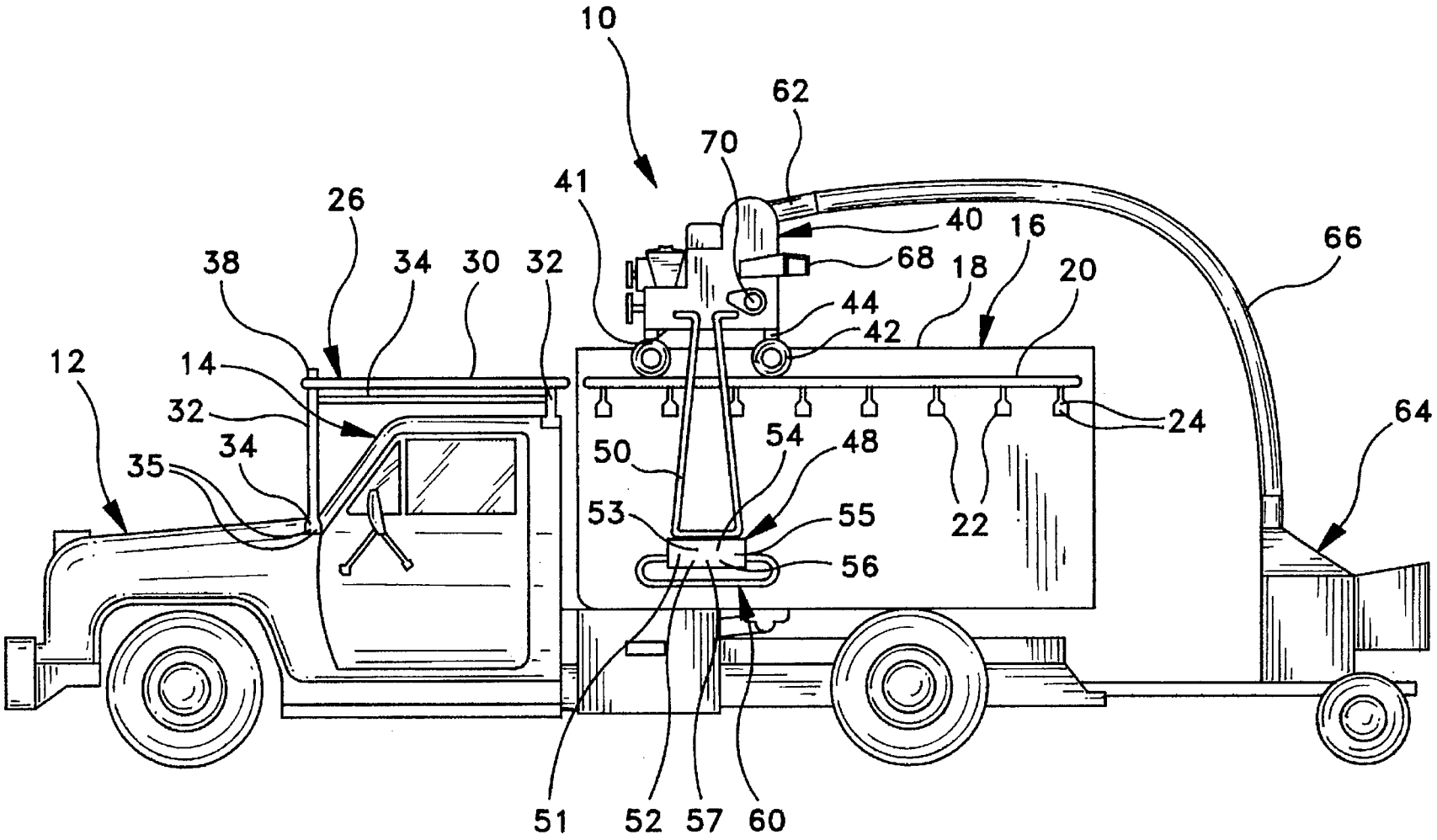
FIG. 1 is a side view of a conventional dump truck having a preferred embodiment of the present invention comminution device installed thereon.

Referring to FIG. 1, there is shown one preferred embodiment of the present invention truck mounted comminution device 10. A dump truck 12 is provided having a passenger cab 14 and a dump bed 16. The dump truck 12 can be any commercially available dump truck or existing dump truck having a dump bed 16 with an open top 18. Rails 20 are mounted onto the dump bed 16 proximate the open top 18. One rail extends along each side of the dump bed 16, wherein the rails 20 are parallel to each other and level with the horizontal when the dump bed 16 is not inclined. Although the rails 20 can be welded to the dump bed 16 or manufactured as part of the dump bed 16, in the shown embodiment, mounting brackets 22 and bolts 24 are used to couple the rails 20 to the dump bed 16. The use of brackets 22 and bolts 24 enables the rails 20 to be retroactively added to any existing dump truck in a simple manner.

An unloading platform 26 is mounted to the dump truck 12 over the passenger cab 14. The unloading platform 26 consists of two rail extensions 30 that align with the rails 20 on the dump bed 16 when the dump bed 16 is in its level position. The rail extensions 30 are held in coaxial alignment with the dump bed rails 20 by support members 32 that extend upwardly from the passenger cab 14. The support members 32 are joined to the passenger cab 14 with mounting brackets 34 and bolts 35, thereby enabling the unloading platform 26 to be retroactively added to any existing dump truck passenger cab. The lengths of the support members 32 are determined by the shape of the passenger cab 14, wherein the lengths and positions of the support members 32 would vary for each model passenger cab on which they are applied. In the preferred embodiment, the support members 32 are mounted to the passenger cab 14, via mounting brackets 34, at points containing the support frame of the passenger cab 14. The position of the support frame elements in a vehicle are known in the art and typically occur at corners of the passenger cab 14, around the doors and in the windshield supports. In an alternative embodiment, the support elements could be manufactured as part of the passenger cab frame at the assembly plant.

A protection grid 34 is suspended between the two rail extensions 30 across the top of the passenger cab 14. The protection grid 34 can be a solid plank of metal or wood, but preferably is a metal lattice structure or similar permeated material. As will be later explained, the protection grid 34 prevents comminuted debris from striking the top of the passenger cab 14 and prevents a person from accessing dangerous regions of the comminution machine 40 when the dump truck 12 is placed in condition to dump. A stop plate 38 also extends across the two rail extensions 30. The stop plate 38 extends upwardly from the rail extensions 30, thereby providing a rigid obstruction across which the comminution machine 40 cannot pass.

The comminution machine 40 is mounted on at least four wheels 42. Each of the wheels 42 engage and ride upon the rails 20 on the dump bed 16. Since the rail extensions 30 align with the dump bed rails 20, the wheels 42 of the comminution machine 40 can also ride upon the rail extensions 30 over the passenger cab 14. As a result, the comminution machine 40 can be rolled along the length of the dump bed 16 and the passenger cab 14. The stop plate 38 at the end of the rail extensions 30 abuts against the comminution machine 40 and prevents the wheels 42 of the comminution machine 40 from being rolled passed the limits of the rail extensions 30.

The comminution machine 40 is supported a predetermined distance above the wheels 42 by leg members 44. The length of the leg members 44 is selected so that the bottom surface 41 of the comminution machine 40 is supported above the open top 18 of the dump bed 16. A control panel 48 extends downwardly from the comminution machine 40, wherein the control panel 48 is suspended by a rigid support element 50. The rigid support element 50 is firmly coupled to the comminution machine 40 and is sized and shaped not to contact either the dump bed 16 or passenger cab 14 as the comminution machine 40 is moved back and forth along the length of the dump truck. The control panel 48 contains the various indicators and controls typically associated with gas fueled comminution devices, such as a key ignition 51, stop switch 52, oil pressure gauge 53, gas gauge 54, tachometer 55, throttle control 56 and choke 57. By positioning these indicators and controls on the suspended control panel 48, the various indicators and controls can be easily accessed by a person standing on the ground next to the dump truck 12. A handle 60 extends around the control panel 48 and couples to the rigid support element 50. As such, it will be understood that by applying a pushing or pulling force to the handle 60, the comminution machine 40 can be selectively moved along the rails 20 and extension rails 30 across the entire length of the dump truck 12.

The comminution machine 40 is a gasoline powered chipper/shredder having three access ports through which materials can be loaded for comminution. The first entrance into the comminution machine is a vacuum feeding chute 62. The vacuum feeding chute 62 may optionally be coupled to a leaf collector 64, via a flexible conduit 66. The vacuum feeding chute 62 draws light weight material, such as leaves and the like, into the comminution machine 40 for reduction. A manual feed chute 68 is provided for directly loading small debris, such as sticks and brush into the comminution machine 40. Lastly, a chipper chute 70 is provided for loading branches and other large objects into the comminution machine 40. All materials entered into the comminution machine 40 via the vacuum feeding chute 62, manual feed chute 68 and chipper chute 70 are reduced and the comminuted debris passes through an opening on the bottom of the comminution machine 40 into the dump bed 16. Thus, it will be understood, that by moving the comminution machine 40 back and forth across the top of the dump bed 16, different sections of the dump bed 16 can be selectively filled.

Figure 2:
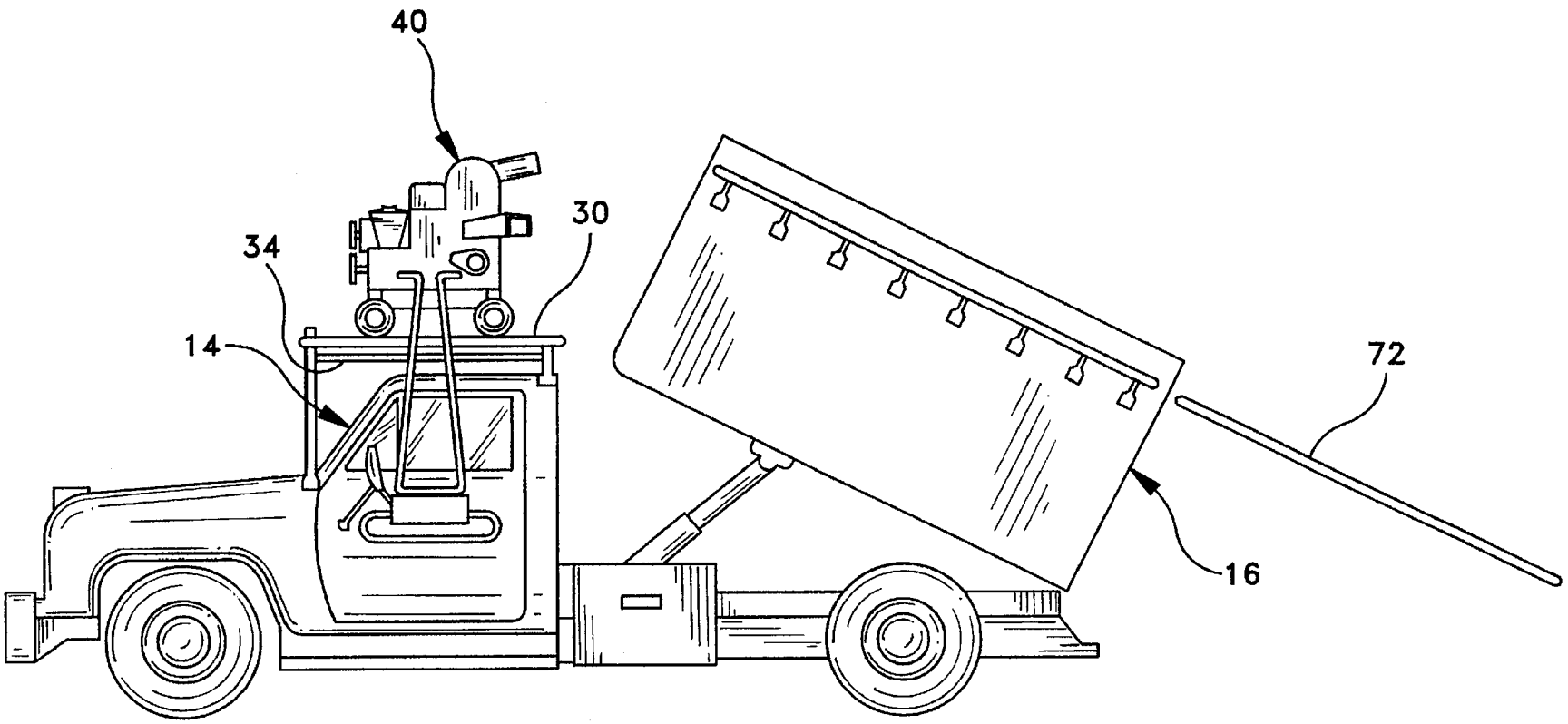
FIG. 2 is a side view of the embodiment shown in FIG. 1, wherein the dump bed of the dump truck is inclined.

Referring to FIG. 2, it can be seen that once the dump bed 16 is full, the comminution machine 40 can be rolled onto the extension rails 30 above the passenger cab 14. Once in this position, nothing remains above the dump bed 16 and the dump bed 16 can be fully raised into its dump position. The protection grid 34 protects any debris from falling out of the comminution machine 40 and onto the top of the passenger cab 14. Similarly, the protection grid 34 prevents anyone from reaching up into the comminution machine 40 from below. Once the comminuted debris is dumped from the dump bed 16 and the dump bed 16 is returned to a level position, the comminution machine 40 can again be rolled onto the rails 20 that straddle the dump bed 16.

In FIG. 2, two optional loading rails 72 are shown. The loading rails 72 are removable rails that can be attached to the dump bed rails 20 when the dump bed 16 is in its raised dump position. The loading rails 72 extend from the ground to the dump bed rails 20 and act as a ramp for loading, or unloading, the comminution machine 40 between the ground and the dump bed rails 20.

Figure 3:
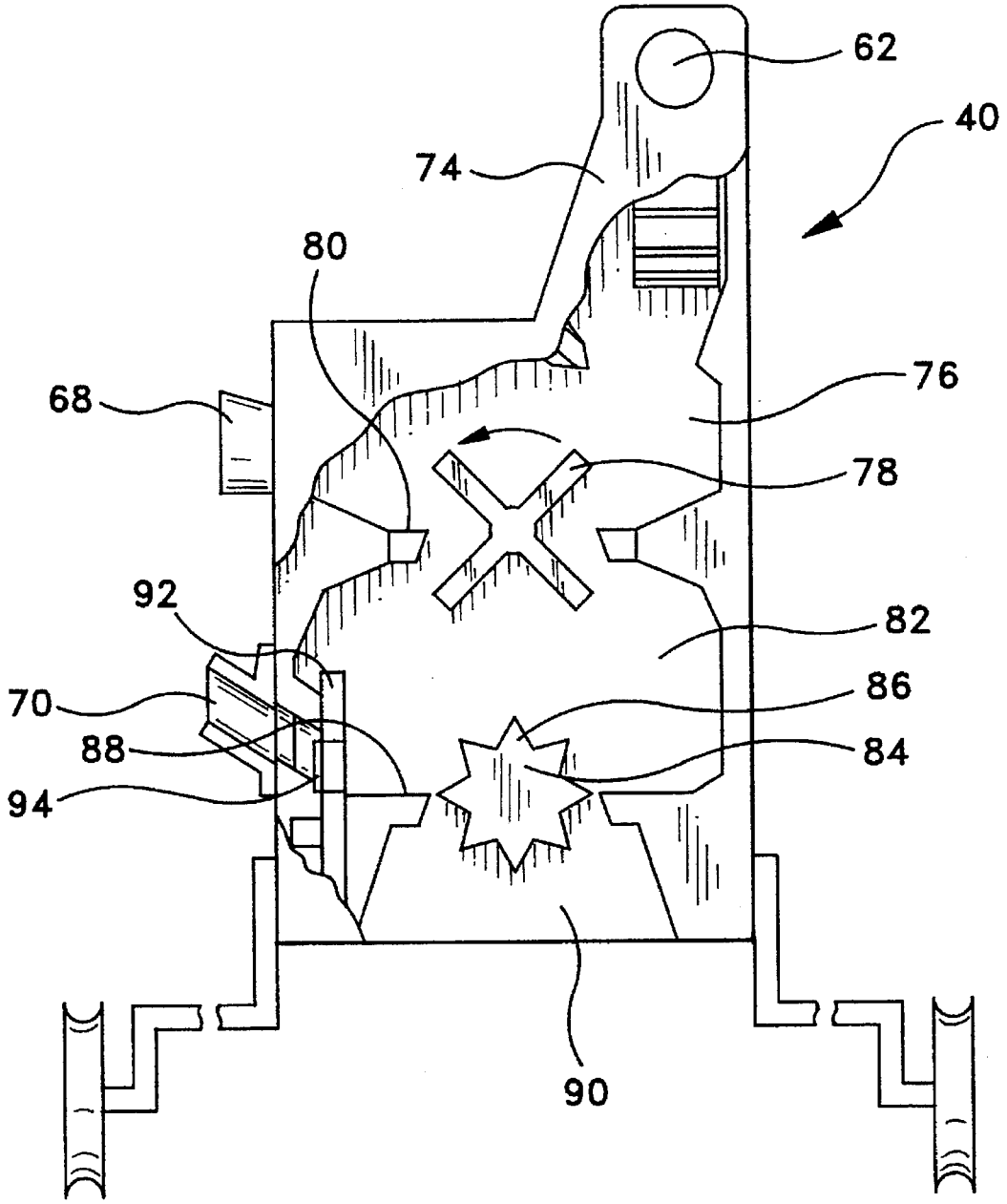
FIG. 3 illustrates the internal component of one preferred embodiment of the comminution machine used in the present invention.

Referring now to FIG. 3, a preferred embodiment of the comminution machine 40 is shown. An impeller assembly 74 is coupled to the vacuum feeding chute 62 for creating a negative pressure within the vacuum feeding chute 62. The negative pressure draws in leaves and other light weight material through the flexible conduit 66 (FIG. 1) and into the vacuum feeding chute 62. Once material is drawn by the impeller assembly 74, the material is deposited in a first processing chamber 76. The manual feed chute 68 also leads into the first processing chamber 76. As such, all materials manually loaded through the manual feed chute 68 also end up within the first processing chamber 76. A plurality of thrashing cutters 78 are disposed at the bottom of the first processing chamber 76. The thrashing cutters 78 are intermeshed with stationary cutting heads 80. As the thrashing cutters 78 rotate past the cutting heads 80, the leaves and other light weight debris are comminuted and passed into a second processing chamber 82. A chipper cutter 84 is disposed at the bottom of the second processing chamber 82. The chipper cutter 84 has cutting teeth 86 that run passed a stationary cutting surface 88, whereby the debris is further comminuted and passed through the exit chute 90 at the bottom of the comminution machine 40.

In FIG. 3, it can also be seen that a chipping head wheel 92 is located proximate the chipper chute 70. The chipping head wheel 92 contains at least one cutting head 94 that rotates across the path of the chipper chute 70. As a result, any branch placed within the chipper chute 70 would engage the cutting head 94 and be comminuted. The comminuted debris from the cutting head 94 is directed into the second processing chamber 82 for further comminution. However, in an alternate embodiment, the comminuted debris from the cutting head 94 can be fed directly into the exit chute 90 and into the dump truck.

The workings of the comminution machine 40 described does not use screens, as is common in many prior art comminution machines. By using a two-step cutting process, with no screens, the comminution machine 40 is particularly well adapted to cut wet materials, such as wet leaves. Since no screens are present, the wet leaves do not clog the machine, thereby greatly reducing the amount of maintenance required during the operation of the comminution machine.

It will be understood that the embodiment described herein is merely exemplary and that a person skilled in the art may make variations and modifications to the described embodiment without departing from the spirit and scope of the invention. All such alternate embodiments, variations and modifications are intended to be included within the scope of the invention as defined in the appended claims.

What is claimed is:

1. A vehicle, comprising:

a passenger cab region;

a dump bed region positionable between a flat orientation and an inclined orientation;

a comminution device for comminuting solid material; and a support means for selectively supporting said comminution device over said dump bed region when in said flat orientation and supporting said comminution device over said passenger cab region when said dump bed region is in said inclined orientation.

2. The vehicle according to claim 1, wherein said support means includes a first set of rails coupled to said passenger cab region and a second set of rails coupled to said dump bed region, wherein said first set of rails align with said second set of rails when said dump bed region is in said flat orientation.

3. The vehicle according to claim 2, wherein said comminution device includes wheels adapted to ride upon rails, wherein said comminution device can be selectively moved between a first position where said wheels ride upon said first set of rails and a second position where said wheels ride upon said second set of rails.

4. The vehicle according to claim 1, further including a chute coupled to said comminution device and a means for drawing solid material into said comminution device through said chute.

5. The vehicle according to claim 4, wherein said comminution device contains a first chamber and a second chamber, wherein said chute communicates with said first chamber and said drawing means draws the solid material into said first chamber.

6. The vehicle according to claim 5, wherein said comminution device includes a first comminution means disposed between said first chamber and said second chamber, wherein said first comminution means comminutes the solid material in the first chamber and feeds the solid material into the second chamber.

7. The vehicle according to claim 6, wherein said comminution device includes an exit port, and the solid material passes from said second chamber into said dump bed through said exit port.

8. The vehicle according to claim 7, wherein said comminution device contains a second comminution means disposed between said second chamber and said exit port, whereby said second comminution means comminutes the solid material in said second chamber and feeds the solid material into said exit port.

9. The vehicle according to claim 7, further including a means for selectively moving said comminution device along said support means for selectively altering the position of said exit port over said dump bed.

10. The vehicle according to claim 8, further including an access port that communicates with said second chamber, wherein said comminution device contains a third comminution means disposed between said access port and said second chamber.

11. The vehicle according to claim 1, further includes a handle coupled to said comminution device, wherein said handle facilitates the selective movement of said comminution device on said support means.

12. The vehicle according to claim 11, wherein said support means supports said comminution device at a predetermined height and said handle extends from said comminution device to a point below said predetermined height.

13. The vehicle according to claim 12, wherein said comminution device contains at least one control and said at least one control is coupled to handle proximate said point below said predetermined height.

14. A method of coupling a comminution device to a vehicle having a dump bed and a passenger cab, comprising the steps of:

mounting a first set of rails to said dump bed;

mounting a second set of rails to said passenger cab;

affixing wheels to said comminution device, wherein said wheels are adapted to ride along said rails; and placing said wheels on said vehicle, wherein said first set of rails supports said comminution device over said dump bed and said second set of rails supports said comminution device over said passenger cab.

15. A method of filling the dump bed of a dump truck with comminuted debris, wherein said dump truck includes a dump bed and a passenger cab, said method comprising the steps of:

mounting a first set of rails to said dump bed;

mounting a second set of rails to said passenger cab;

placing a comminution device on said first set of rails whereon said comminution device is suspended over said dump bed;

feeding debris into said comminution device, wherein said comminution device comminutes the debris and deposits the debris into said dump bed, and moving said comminution device onto said second set of rails, thereby removing said comminution device from over said dump bed.

16. The method according to claim 15, further including the step of selectively moving said comminution device along said first set of rails to fill different sections of said dump bed.

* * * * *